US006460311B1

(12) United States Patent
Ito

(10) Patent No.: US 6,460,311 B1
(45) Date of Patent: Oct. 8, 2002

(54) FIXTURE FOR BOARDING, AND HORIZONTAL BOARDING METHOD USING THE FIXTURE

(75) Inventor: Hiroshi Ito, Aichi (JP)

(73) Assignee: Nichiha Corp., Aichi (JP)

( * ) Notice: Subject to any disclaimer, the term of this patent is extended or adjusted under 35 U.S.C. 154(b) by 0 days.

(21) Appl. No.: 09/484,201

(22) Filed: Jan. 18, 2000

(30) Foreign Application Priority Data

Apr. 2, 1999 (JP) ..... 11-099640

(51) Int. Cl.[7] ..... E04C 3/30

(52) U.S. Cl. ..... 52/731.9; 52/489.1; 52/747; 52/589.1; 52/506.01

(58) Field of Search ..... 52/483.3, 747.1, 52/731.1, 731.7, 489.1, 763, 235, 714

(56) References Cited

U.S. PATENT DOCUMENTS 4,483,122 A * 11/1984 Crandell ..... 52/747
6,202,377 B1 * 3/2001 Krieger ..... 52/489.1
6,237,295 B1 * 5/2001 Ballard ..... 52/589.1
6,289,646 B1 * 9/2001 Watanabe ..... 52/506.01

FOREIGN PATENT DOCUMENTS

| | | | |
|---|---|---|---|
| JP | 2-81842 | 6/1990 | |
| JP | 4-113632 | 10/1992 | |
| JP | 5-7832 | 2/1993 | |
| JP | 6-65539 | 9/1994 | |
| JP | 06299673 A | * 10/1994 | ..... E04F/13/08 |
| JP | 6-299673 | 10/1994 | |
| JP | 7-18817 | 1/1995 | |
| JP | 3009604 | 1/1995 | |
| JP | 11062170 | 3/1999 | |

* cited by examiner

*Primary Examiner*—Carl D. Friedman
*Assistant Examiner*—Steve Varner
(74) *Attorney, Agent, or Firm*—Lowe Hauptman Gilman & Berner, LLP

(57) ABSTRACT

A fixture having a lateral width which is larger than an interval between a couple of neighboring studs is to be fixedly attached to the neighboring studs so as to bridge the couple of neighboring studs, when a joint portion between the vertical sides of neighboring siding boards arranged horizontally does not coincide with the position of any of said studs, thereby fastening the joint portion of a couple of neighboring siding boards by making use of the second fixture.

14 Claims, 14 Drawing Sheets

FIXTURE FOR BOARDING, AND HORIZONTAL BOARDING METHOD USING THE FIXTURE

BACKGROUND OF THE INVENTION

1. Field of the Invention

The present invention relates to a fixture to be employed for a horizontal boarding for building frame using for instance a ceramic siding board, in which the siding boards are attached to a building frame with the longitudinal direction of each ceramic siding board being orientated in the horizontal direction. The present invention also relates to a method of fastening the siding boards for building frame in the horizontal boarding using the fixture.

2. Description of the Related Arts

As an exterior work of a house, a boarding for attaching ceramic siding boards to a frame construction is usually performed.

This boarding using siding boards has been performed either by a horizontal boarding where the siding boards are attached to the frame construction with the longitudinal direction of the siding boards being directed in the lateral direction (horizontal direction), or by a vertical boarding where the siding boards are attached to the frame construction with the longitudinal direction of the siding boards being directed in the upright direction (vertical direction). As shown in FIGS. 14 and 15, in the case of wood frame construction (two-by-four work) for example, a framework 10 is assembled at first, and after a backing material 3 such as a plywood or a moisture permeable waterproofing sheet is attached as desired to the framework 10, ceramic siding boards 40 are fixedly fastened to the framework 10 by taking advantage of the studs 12 of the framework 10.

In the case of the horizontal boarding, a first siding board 40 to be disposed at the lowest portion of the frame work 10 is horizontally placed at first to the framework 10 and fastened thereto using nails 62 by taking advantage of studs 12. Then, a second siding board 40 to be fastened over the first siding board 40 is horizontally placed with the lower rabbeted horizontal edge 40a of the second siding board being fitted over or engaged with the upper rabbeted horizontal edge 40b of the first siding board 40, and then fastened to the studs 12 in the same manner as illustrated above using nails 62. Since the head 62*a* of the nail 62 employed in fastening the siding board 40 is exposed in this case, thus deteriorating the external appearance or design of the finish, a coating coverage is usually subsequently applied to such an exposed head portion of the nails 62. Further, there is also a possibility that the siding boards 40 may be damaged due to the nailing work.

With a view to overcome the aforementioned problems, a method of fastening the siding boards by making use of a metallic fixture exclusively dedicated for the siding boards has been proposed as taught in Japanese Patent Unexamined Publication H9-203184. FIG. 16 shows one example of such a metallic fixture (hereinafter, referred to also as a metallic fixture) 30. As shown in FIG. 17, this metallic fixture 30 is adapted to be fastened to the studs 12 using screws or nails 62 which are to be applied through holes 34 formed in the substrate 31. In this example, the siding board 40 is formed of a laterally elongated shape, four sides of which are respectively formed into a shiplap configuration. Specifically, the overlying rabbeted portion thereof is consisted of a overlying tongue patterning portion 41 constituting the front side of the overlying rabbeted portion, an overlying tongue engaging portion 42 constituting the back side of the overlying rabbeted portion, and a groove portion 43 formed between the pattern-forming upper tongue portion 41 and the overlying tongue engaging portion 42. On the other hand, the underlying rabbeted portion thereof is formed at the upper side of the siding board arranged below, covered by the overlying tongue patterning portion 41, and consisted of an underlying tongue engaging portion 44 being attached to the metallic fixture 30.

The installation of the siding boards 40 can be performed as follows. First of all, the distal edge portion of the underlying tongue engaging portion 44 of a lower siding board 40B is fitted in the lower engaging portion 50B (which is formed with a substrate 31, a horizontal portion 32 and a downwardly inclined hook portion 33B) of the metallic fixture 30 which has been fixedly attached in advance to the studs 12 by means of screws or nails 62, thereby securing the lower siding board 40B to studs 12. Then, the overlying tongue engaging portion 42 of an upper siding board 40A is fitted in the upper engaging portion 50A (which is formed with a substrate 31, a horizontal portion 32 and a upwardly inclined hook portion 33A) of the metallic fixture 30, thereby securing the upper siding board 40A to studs 12. Since the upper siding board 40A and the lower siding board 40B are joined in this manner, there is little possibility that the surface of the siding boards is damaged, and the existence of the metallic fixture 30 cannot be externally recognized, thus making it possible to provide a very excellent external appearance of boarding.

In the horizontal boarding as mentioned above, the horizontal joint is a shiplap joint when four sides of the siding board are respectively formed into a shiplap configuration, on the other hand, the horizontal sides are simply butt against each other when only the vertical sides of the siding board are formed into a shiplap configuration.

In the meantime, in the case of wood frame construction (two-by-four work), a framework is fabricated according to the standard dimension, and hence the distance between studs is constant (for example, 16 inches and 24 inches). If the length in longitudinal direction of the siding board is an integral multiple of the standard distance between the centers of studs, the joint portion between the vertical sides of siding boards arranged horizontally would coincide with the position of any of the studs of the framework, so that the joint portion between the vertical sides of siding boards can be firmly fastened to the studs by simply attaching a couple of siding boards side by side to the fixtures fixed in advance to the studs.

However, if the length in longitudinal direction of the siding board is not an integral multiple of the standard distance between the centers of studs, the joint portion between the vertical sides of siding boards arranged horizontally would not coincide with the position of the studs of the framework. This situation tends to happen occasionally when the framework to be employed in a wood frame construction is manufactured based on a different standard from the standard of the siding boards, or when siding boards manufactured are required to be cut at an intermediate portion thereof due to certain circumstances. This situation is also caused to happen when, due to the design of house, a framework of off-specification is required to be partially employed.

When there is a portion in the boarding construction where the joint portion between the vertical sides of siding boards does not coincide with the position of the studs of the framework in the installation of siding boards by making use of metallic fixtures secured in advance to each stud, the joint portion may be simply left in a state of shiplap joint or in a contacted state, so that the joint portion may become very weak in mechanical strength. Therefore, if an external force is happened to be applied to such a joint portion, the joint portion is more likely to be displaced, and rain water may penetrate into the inside of the siding boards through this displaced joint portion.

Another problem accompanied with the boarding using the conventional fixture is that the metallic fixture fastening vertical siding boards is likely to be displaced due to the weight of the siding boards. Such a problem may not be raised when the metallic fixture is directly nailed to a non-deformable material such as a wood stud. However, when it is desired that a thick backing board formed of a relatively soft material such as a foamed resin board or a wood fiber board such as OSB is attached at first as a heat-insulating material to studs before a fixture is secured via the aforementioned thick backing board to the wood stud, the employment of such a fixture 30 as shown in FIG. 16 would result in a sinking of the leg portion 31*a* of the metallic fixture 30 in the backing board due to the weight of the siding boards. As a result, the metallic fixture 30 would be inclined, whereby the siding boards would be instabilized, thus giving rise to the generation of displacement or warpage of the siding boards.

A further problem accompanied with the boarding using the conventional fixture is that fixtures of various size which are exclusively dedicated for siding boards of various thickness such as a 16 mm-thick siding board or a 18 mm-thick siding board are required to be separately fabricated by a process involving a drawing work of a specific metallic substrate. The manufacture of fixtures of various kinds necessitates a lot of working steps.

SUMMARY OF THE INVENTION

The present invention has been made in view of overcoming the aforementioned problems that may be caused in the horizontal boarding using the conventional fixtures for installing the siding boards to a framework assembled according to a wood frame construction.

Therefore, an object of the present invention is to provide a fixture which is capable of stably fix the joint portion between the vertical sides of neighboring siding boards even if the studs and the siding boards are fabricated according to a different standard from each other, and capable of preventing from being displaced due to the weight of the siding boards even if the fixture is attached via a relatively soft backing material to the studs.

Another object of the present invention is to provide a horizontal boarding method using the aforementioned fixture.

A further object of the present invention is to provide a fixture which is capable of reliably preventing rain water from penetrating into the back side of the siding boards through the joint portion between the vertical sides of neighboring siding boards.

A still another object of the present invention is to provide a method for manufacturing a plural kinds of fixtures which are to be employed for fastening siding boards having a different thickness from each other by making use of a common metallic substrate and a small number of working steps.

A still another object of the present invention is to provide a fixture that can be manufactured according to the aforementioned manufacturing method.

With a view to realize the aforementioned objects, the present invention provides a fixture useful for a horizontal boarding to be performed by making use of studs erected side by side, said fixture comprises;

a flat substrate constituting a mounting surface to be contacted with said studs; a flat portion protruded forward from said flat substrate; an upright portion protruded forward perpendicular to said flat portion and extending throughout an entire lateral width of said flat portion; and an engaging portion formed at a distal end of said upright portion;

wherein fixture has a laterally elongated width having a sufficient dimension to bridge neighboring two studs.

The present invention also provides a horizontal boarding method for installing siding boards to a building frame using the aforementioned fixture, said method comprising the steps of; fixedly attaching a first metallic fixture having an engaging portion to be engaged with a horizontal side edge of the siding board to each of the studs erected side by side with said engaging portion being orientated horizontally; horizontally placing said siding boards on said first metallic fixture while allowing a lower horizontal side edge to be engaged with said engaging portion of said first metallic fixture attached to said studs; fixedly attaching another metallic fixture having the same configuration as that of said first metallic fixture to said studs with the engaging portion thereof being engaged with an upper horizontal side edge of said siding boards placed horizontally; and repeating the aforementioned steps; which is characterized in that when a joint portion between the vertical sides of neighboring siding boards arranged horizontally does not coincide with the position of any of said studs, the aforementioned metallic fixture is fixedly attached as a second fixture to bridge a couple of neighboring studs between which said joint portion between the vertical sides of siding boards is to be located thereby fastening said joint portion of a couple of neighboring siding boards by making use of said second fixture.

According to this siding method, even when a joint portion between the vertical sides of neighboring siding boards arranged horizontally does not coincide with the position of any of said studs but is positioned at an intermediate place between the studs due to a difference in standard with which the studs and siding boards are separately fabricated, the joint portion can be securely fastened by the second fixture, and hence, these neighboring couple of siding boards can be stably installed to the studs.

According to a preferable embodiment of this siding method, said first fixture employed therein comprises a flat substrate constituting a mounting surface to be contacted with said studs; a first upright portion formed vertically on one side of said substrate; a second upright portion formed vertically on the other side of said substrate; a third upright portion extending perpendicular to said flat substrate; and an engaging portion formed at a distal end of said third upright portion; wherein the siding boards to be installed are fastened by allowing the horizontal sides thereof to be clamped between the distal end portions of said first and second upright portions and said engaging portion formed at the distal end of said third upright portion.

It is possible according to the present invention to apply, as a heat insulating material, a thick backing board formed of a relatively soft material such as a foamed resin board to the studs, and then, to fixedly attach the aforementioned first and second fixtures to the studs with the backing board being interposed therebetween. Since the first and second fixtures are respectively provided with a flat substrate portion, there is no possibility, even if the first and second fixtures are fastened through such a backing board to the studs, that the leg portions of the metallic fixture are sunk in the backing board due to the weight of the siding boards, thereby causing a displacement of the metallic fixture as seen in the case of the conventional fixture. Therefore, it is possible according to the present invention to ensure the stability of the siding boards and to prevent the generation of displacement or warpage of the siding boards.

The upright portion of the second fixture may be provided with openings for draining water, thereby more reliably preventing the back surface of the siding boards from being kept in a wet condition. Alternatively, the second fixture may be constructed such that a U-groove which is recessed backward is formed in the flat portion protruded forward from the flat substrate, the bottom of the U-groove constituting the same level as that of the flat substrate and being provided with through-holes for nailing. This second fixture constructed in this manner is advantageous in that the fixing thereof to the studs can be further ensured.

More preferably, the engaging portion formed at a distal end of the upright portion of the second fixture is configured into a triangular shape in cross-section with the top portion thereof being made into a flat surface. If the second fixture is configured in this manner, even if the joint portion between the vertical sides of neighboring siding boards is located at an intermediate portion between the studs, it is possible to more effectively prevent rain water from penetrating through this joint portion into the backside of the siding boards. More preferably, the aforementioned triangular cross-sectional portion of the second fixture should be hollow for the purpose of reducing the total weight of the second fixture. The second fixture having such a configuration can be easily manufactured by an extrusion molding of aluminum.

As for the first fixture, the third upright portion thereof is formed of a bent piece of the substrate portion, the bent portion thereof being curved by a pressing-up from the back surface of the substrate portion. When the first fixture is constructed in this manner, a plural kinds of fixtures each being adapted for use in the fastening of a plural kinds of siding boards each differing in thickness can be manufactured using a common metallic substrate and requiring a reduced number of manufacturing steps, thereby making it possible to minimize the manufacturing cost of the fixtures.

Additionally, according to the present invention, the ventilation passage between the building frame and the siding boards is secured by the height of the first and second upright portions formed in the first fixture, as well as by the flat portion protruded forward and formed in the second fixture. As a result, it is possible to effectively discharge any dewy water generated therein, thus making it possible to prevent the back surface of the siding boards from being kept in a wet state.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
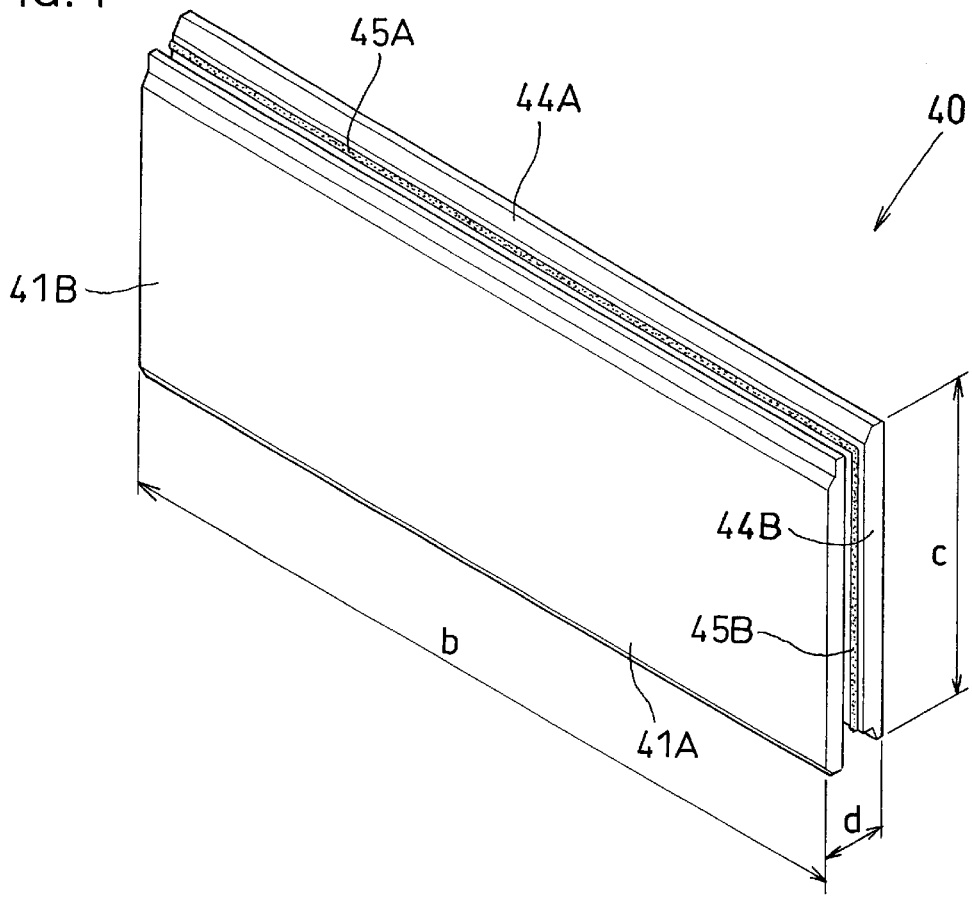
FIG. 1 is a perspective view of a siding board representing one embodiment of the present invention.
Figure 2:
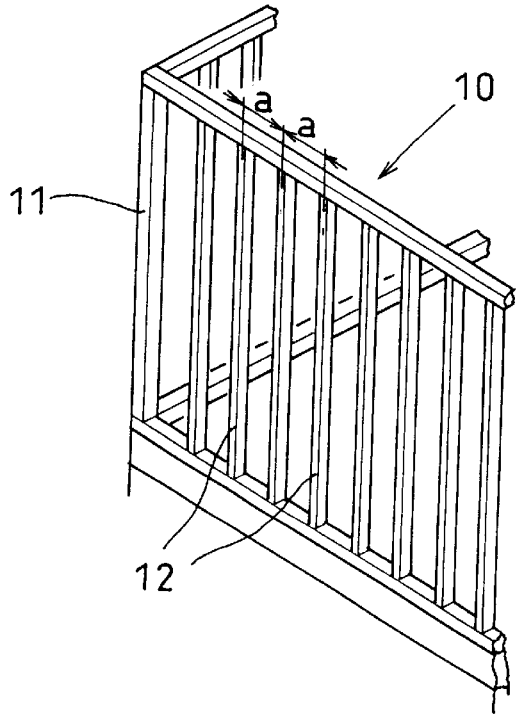
FIG. 2 is a perspective view illustrating one example of frame work for installing siding boards.

Preferable embodiments of the present invention will be explained in details below with reference to the drawings. FIG. 1 shows a perspective view illustrating one example of a siding board, and FIG. 2 is a perspective view illustrating one example of frame work for installing the siding board shown in FIG. 1.

A siding board (building panel) 40 in this embodiment is a ceramic siding board having a dimension of about 180 cm (the lateral width "b")×about 45 cm (the longitudinal width "c")×about 18 cm (the thickness "d") for instance. A frame work 10 is the one which is employed in the ordinary wood frame construction and is composed of frames 11 constituting the four sides of a frame work 10 and a predetermined number of studs 12 equidistantly spaced apart from each other. The frame work 10 is all made of wood. The distance "a" between the centers of a couple of neighboring studs 12 is set to 16 inches (406 mm) as a standard dimension.

Figure 3:
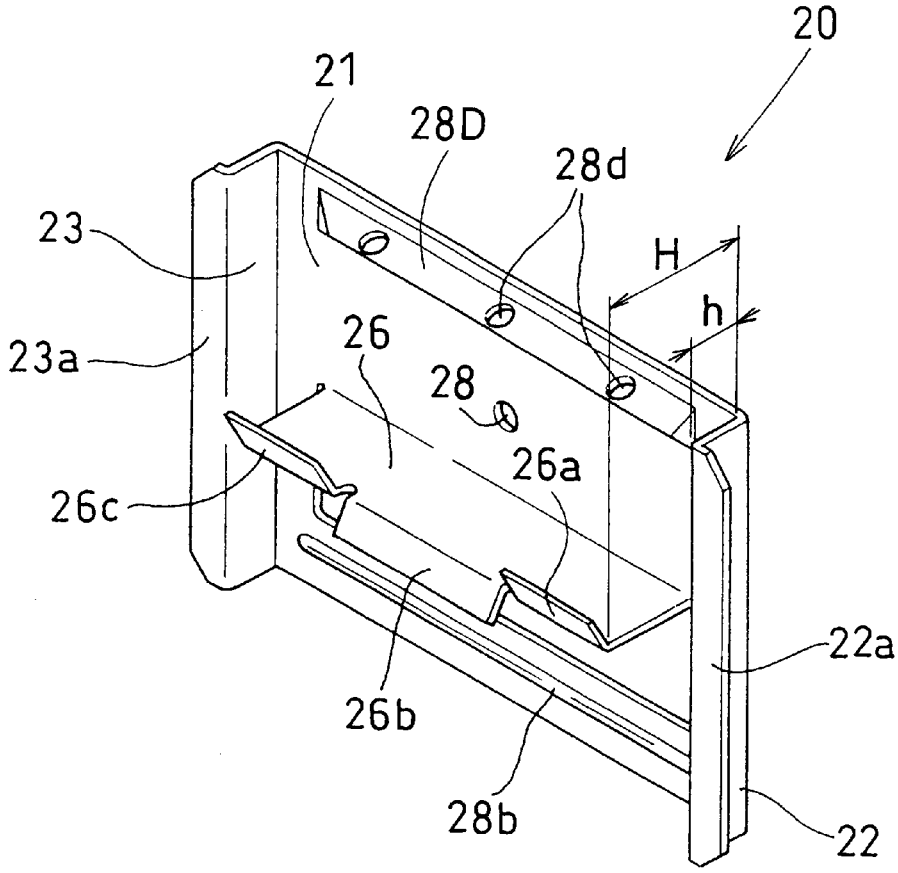
FIG. 3 is a perspective view illustrating a first fixture.
Figure 4:
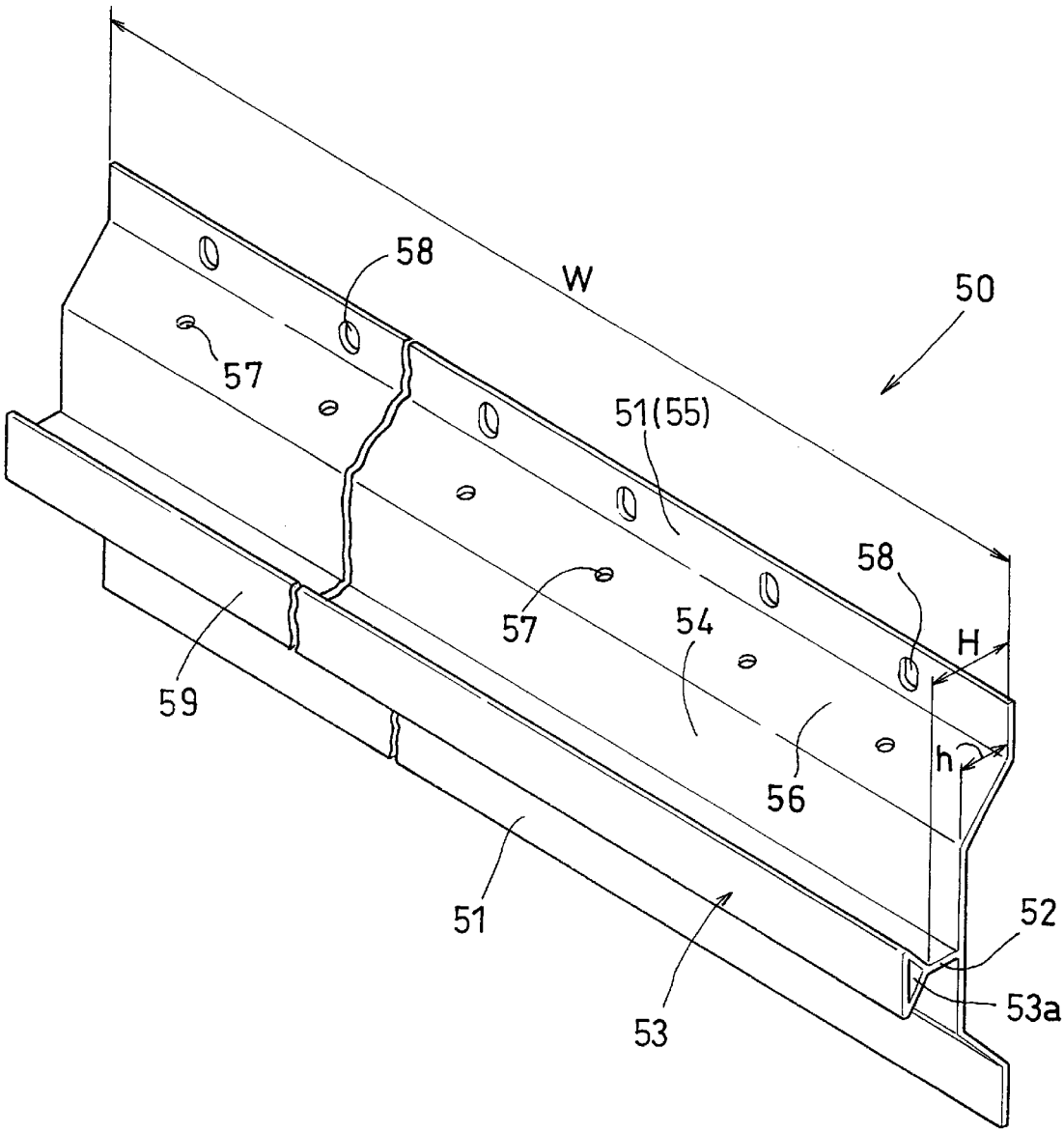
FIG. 4 is aperspective view illustrating a second fixture.

FIG. 3 shows a perspective view illustrating a first fixture 20, while FIG. 4 shows a perspective view illustrating a second fixture 50. As explained hereinafter, the siding boards 40 are designed to be horizontally installed to the frame work 10 by making use of the first fixture 20 and the second fixture 50.

Figure 17:
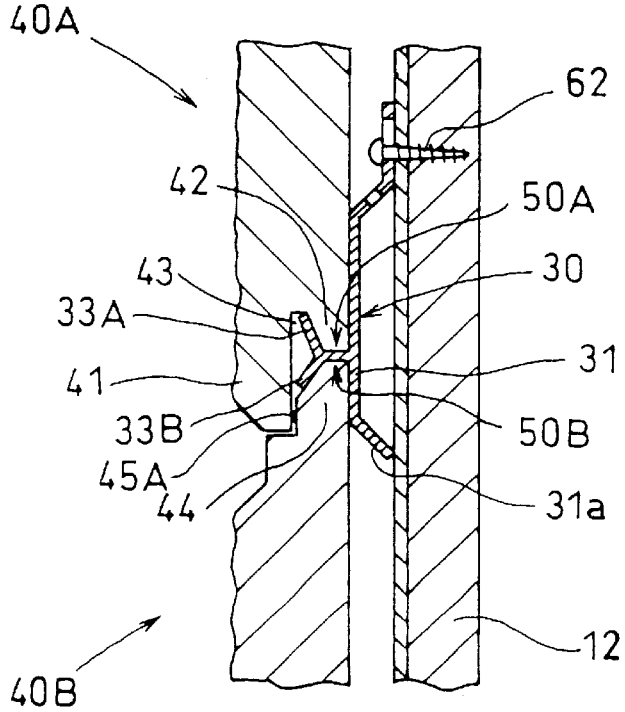
FIG. 17 PRIOR ART
FIG. 17 is a cross-sectional view illustrating a state where the siding boards are installed according to the conventional horizontal boarding.

First of all, the structure of the siding board 40 will be explained in details. FIG. 1 shows the front side of the siding board 40 which is provided at the upper side and right side thereof with an underlying tongue, and at the lower side and left side thereof with an overlying tongue. Specifically, as shown in detail in FIG. 17, this siding board 40 is provided at the upper side thereof with an underlying tongue-attached portion 44A extending in the horizontal direction, and at the right side thereof with an underlying tongue-attached portion 44B extending in the vertical direction. A caulking material layers 45A and 45B are deposited at the front side portions (the portions which are somewhat spaced apart from the inner edge formed in the middle of the front surface of the tongue) of the underlying tongue-attached portions 44A and 44B, respectively. The overlying tongues formed at the lower side and left side of the siding board 40 are constituted by an overlying tongue patterning portion 41A and by an overlying tongue patterning portion 41B, respectively.

Next, the features of the first fixture 20 will be explained. In this embodiment, the first fixture 20 is made by plate work after blanking of a stainless steel. Specifically, this first fixture 20 comprises a flat substrate 21 constituting a surface for mounting the first fixture 20 onto a building frame, i.e. onto the studs of a framework, a first upright portion 22 which has been formed by bending the right side portion of the substrate 21 by an angle of approximately 90 degrees thereby rendering the bent portion to extend vertically, the tip end portion of the first upright portion 22 being further bent outward or rightward by an angle of 90 degrees thereby to form a horizontal plane 22*a* which is parallel with the substrate 21, and a second upright portion 23 which has been formed by bending the left side portion of the substrate 21 by an angle of approximately 90 degrees thereby rendering the bent portion to extend vertically, the tip end portion of the second upright portion 23 being further bent outward or leftward by an angle of 90 degrees thereby to form a horizontal plane 23*a* which is parallel with the substrate 21.

A portion of the substrate 21 which is located between the first upright portion 22 and the second upright portion 23 is cut and bent perpendicular to the surface of the substrate 21, thereby forming a third upright portion 26 extending horizontally. The height "H" of this third upright portion 26 is set higher than the height "h" of both first and second upright portions 22 and 23, the difference between them (H–h) being set to correspond with the thickness of the tip ends of the underlying tongue-attached portions 44A of the siding board 40 to be installed (see FIG. 8).

Three locking strips 26*a*, 26*b* and 26*c*, each being bent in the opposite direction to each other alternately, are formed along the top end portion of this third upright portion 26. Further, a first rib 28*b* is formed at a lower portion of the substrate 21 for reinforcing the substrate 21. A second rib 28D having a height higher than that of the first rib 28*b* is formed at an upper portion of the substrate 21. Through-holes 28*d* are formed in the upper inclined surface of the second rib 28D, these through-holes 28*d* being adapted to be utilized for nailing the first fixture 20 to the studs 12.

Next, the features of the second fixture 50 will be explained. In this embodiment, the second fixture 50 is manufactured by an extrusion molding of aluminum. Specifically, this second fixture 50 comprises a flat substrate 51 constituting a mounting surface to be contacted with said studs 12; a flat portion 54 protruded forward by a distance of "h" from the flat substrate 51; an upright portion 52 protruded forward perpendicular to the flat portion 54 and extending throughout an entire lateral width of the flat portion 54; and an engaging portion 53 having a triangular cross-section and formed at a distal end of the upright portion 52.

The distance "H" from the flat substrate 51 to the tip end of the upright portion 52 is identical with the height "H" of the third upright portion 26 of the first fixture 10, while the distance "h" between the flat substrate 51 and the flat portion 54 is identical with the height "h" of both first and second upright portions 22 and 23 of the first fixture 10.

The slant portion 56 interposed between the flat portion 54 and the flat substrate 51, and connecting the upper edge of the flat portion 54 with the upper horizontal portion 55 of the flat substrate 51 is provided with through-holes 57. Further, the upper horizontal portion 55 of the flat substrate 51 is also provided with through-holes 58. These through-holes 57 and 58 are adapted to be utilized for nailing the second fixture 50 to the studs 12.

The width "W" in lateral direction of the second fixture 50 is set wider than the distance between the outer sides of the neighboring two studs 12 constituting the framework 10, so that this second fixture 50 can be attached to the studs in a state bridging a couple of neighboring studs 12.

The top surface 59 of the engaging portion 53 having a triangular cross-section in the upright portion 52 is made flat, thus making it possible as explained hereinafter to more effectively prevent rain water from penetrating through the joint portion between the vertical sides 41B and 44B of the neighboring siding boards 40. Additionally, this triangular cross-sectional portion of the second fixture 50 is made into a hollow portion 53*a* for the purpose of reducing the total weight of the second fixture 50.

Next, the method of horizontal boarding of the siding boards 40 to the framework 10 by making use of the first and second fixtures 20 and 50 will be explained. In this embodiment, it is designed that a foamed resin board 30 having a thickness of about 10 to 20 mm is attached as a heat-insulating material to the framework 10 at first, and then, the siding boards 40 are horizontally installed via this foamed resin board 30 to the framework 10.

Figure 5:
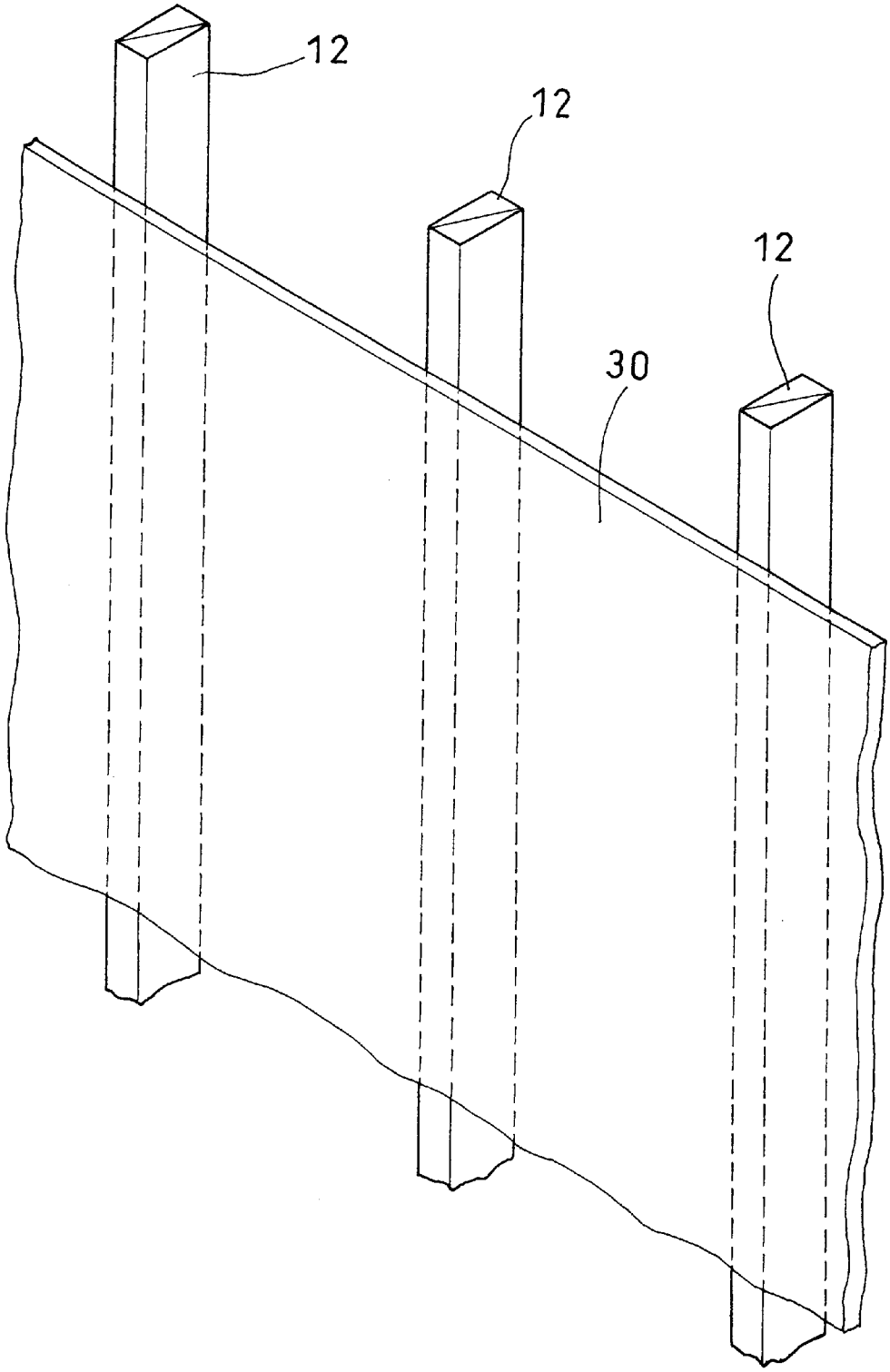
FIG. 5 is a perspective view illustrating a state wherein a backing board is attached to the studs.
Figure 6:
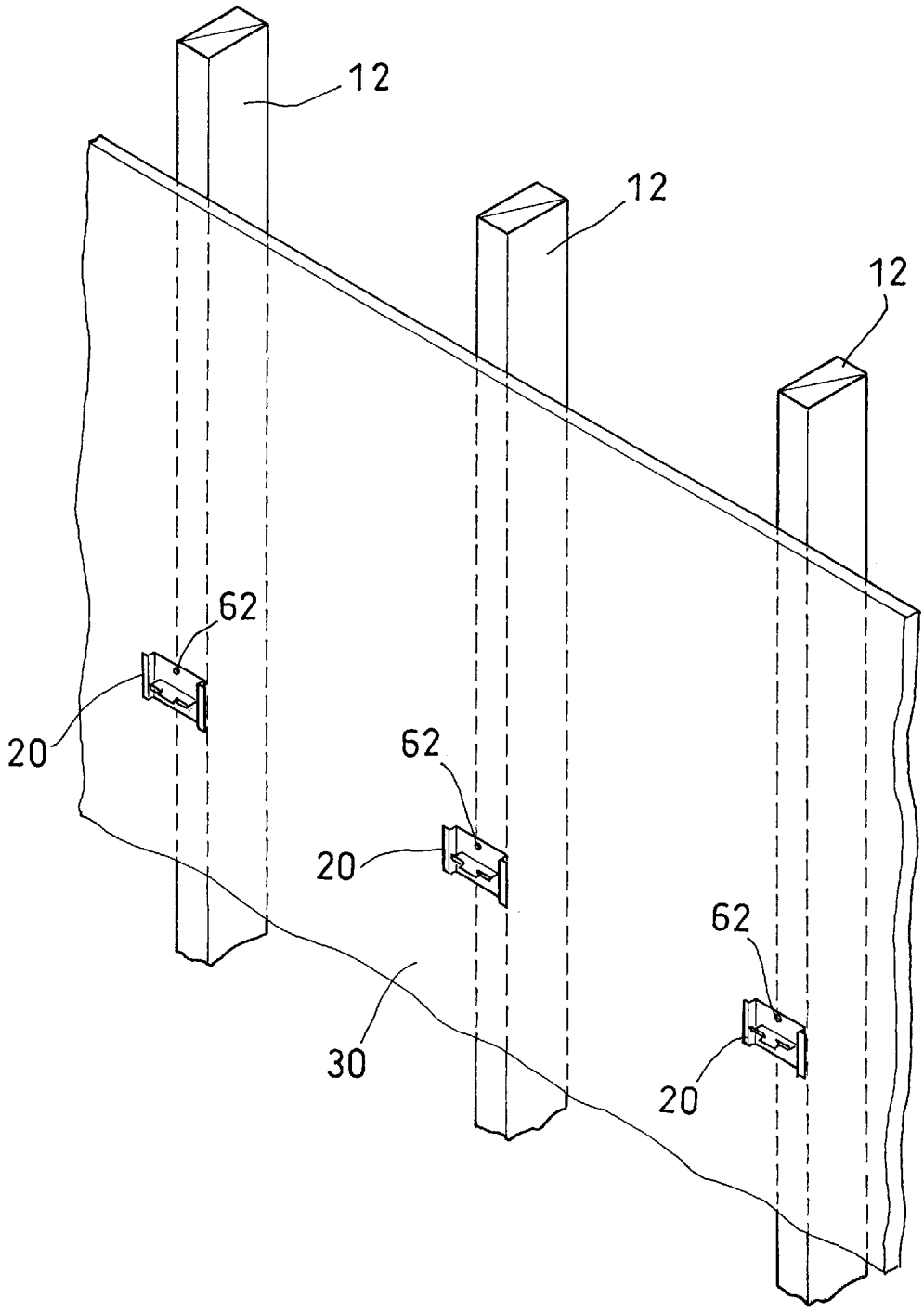
FIG. 6 is a perspective view illustrating a state wherein a first fixture is attached to the studs.

First of all, as shown in FIG. 5 illustrating a partial enlarged view of the framework, the foamed resin board 30 is attached to the frame 10 by a suitable method making use of the studs 12 if required. Then, as shown in FIG. 6, by making use of a locking screw or nail 62, a required number of the first fixtures 20 as shown in FIG. 3 are fixedly attached via the foamed resin board 30 to a portion of each stud 12 where the lower side edge of the siding board 40 is to be positioned. In this case, each first fixture 20 is arranged such that three locking strips (an engaging portion) 26*a*, 26*b* and 26*c* formed at the distal end of the third upright portion 26 are kept in the horizontal state.

Figure 7:
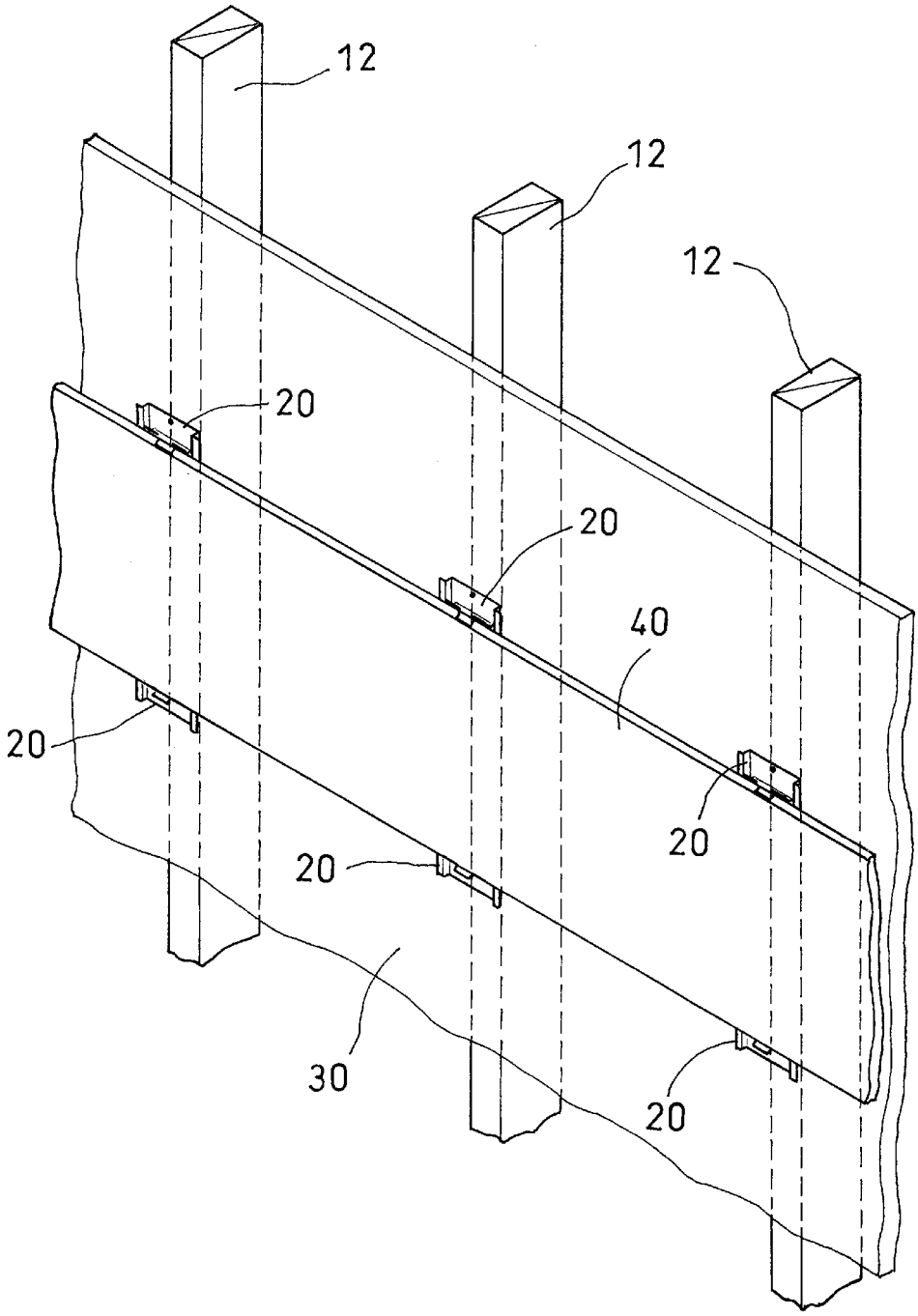
FIG. 7 is a perspective view illustrating a state wherein a siding board is attached to the studs.

Then, as shown in FIG. 7, the siding board 40 is horizontally installed in such a way that the overlying tongue engaging portion 42 formed on the rear side and constituting a lower horizontal edge of the siding board 40 is engaged with the upwardly inclined locking strips 26*a* and 26*c* formed at the distal end of third upright portion 26 of the fixed first fixture 20. Thereafter, by making use of a locking screw or nail 62, a required number of the first fixtures 20 are fixedly attached via the foamed resin board 30 to the studs 12 in such a manner that the downwardly inclined locking strip 26*b* formed at the distal end of third upright portion 26 of the fixed first fixture 20 is engaged with the underlying tongue engaging portion 44 constituting the upper horizontal side of the siding board 40 placed horizontally. By going through these procedures, the installation work of one sheet of siding board 40 can be finished. Subsequently, the same procedures as mentioned above are repeated thereby successively performing the installation of the siding boards 40.

Figure 8:
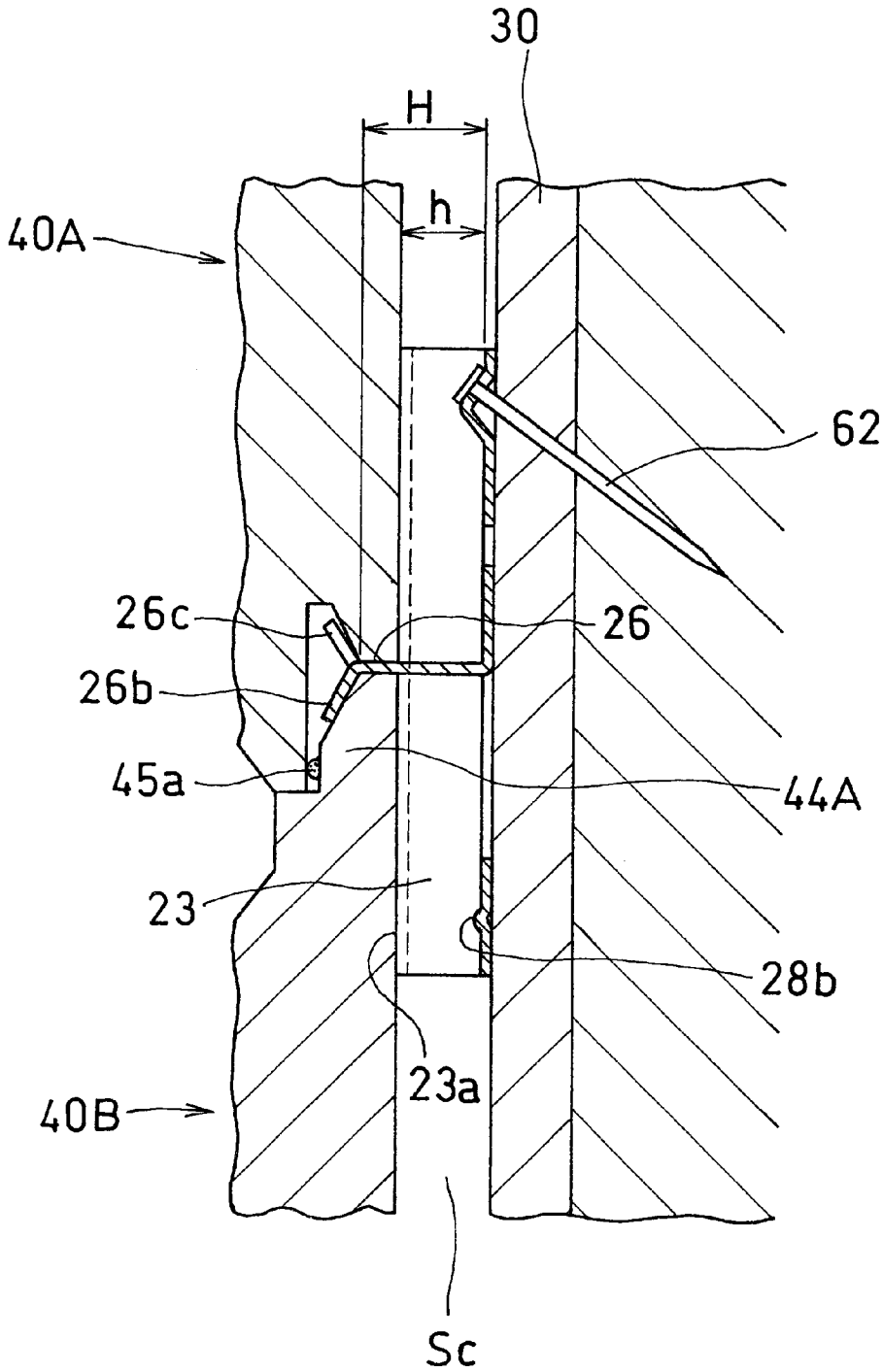
FIG. 8 is a cross-sectional view illustrating a state wherein a siding board is attached to the studs.

FIG. 8 shows a cross-sectional view illustrating part of the installed siding board 40 to the framework. Since the first fixture 20 is covered from outside by the installed siding boards 40, an excellent external design can be assured after the installation of the siding boards 40. Further, since the flat substrate 21 of the first fixture 20 is plate-like, there is little possibility that the first fixture 20 is inclined or displaced due to the weight of the fastened siding boards 40 even if the first fixture 20 is nailed, through the foamed resin board 30 which tends to be deformed, to studs 12. Furthermore, since a space due to the height "h" of the first and second upright portions 26 and 27 of the first fixture 20 is formed between the front surface of the foamed resin board 30 and the rear side of the siding boards 40, this space portion can be functioned as a ventilation passage, so that it is possible to inhibit the generation of dew on the rear side of the siding boards 40. Further, even if dew is generated on the rear side of the siding boards 40, the dew can be effectively discharged downward through this space, thus making it possible to prevent the back surface of the siding boards from being kept in a wet state.

In this embodiment, the distance "a" between the centers of the neighboring studs 12 is set to 16 inches (about 40 cm), whereas the length in lateral direction of the siding board 40 is 180 cm. The length in lateral direction of the siding board 40 is not an integral multiple of the distance "a" between the centers of the neighboring studs 12 because manufacturable widths of a siding board is limited to a predetermined width according to a production line. Since 180 cm is not an integral multiple of 40 cm, if the left end of the siding board 40*a* is aligned with a first stud 12-1 in the framework where the studs are equidistantly erected at an interval of 40 cm as shown in FIG. 9, the vertical side on the right end of this siding board is caused to be located at an intermediate portion between a fifth stud 12-5 and a sixth stud 12-6.

When another first fixture 20 is nailed and fixed to the sixth stud 12-6 in the same manner as mentioned above, and then, another siding board 40*b* is installed on the right side of the siding board 40*a*, the joint portion between the vertical sides of the left siding board 40*a* and the right siding board 40*b* is caused to be located at an intermediate portion between the fifth stud 12-5 and the sixth stud 12-6. Therefore, even if a shiplap joint between the overlying tongue patterning portion 41B and the underlying tongue-attached portion 44B is realized, the fastening strength of the joint portion would become unstable, because the joint portion is not directly fixed to the building frame or the framework 10. The second fixture 50 shown in FIG. 4 can be employed substituting for the first fixture 20 if the above-mentioned situation is brought about.

Figure 9:
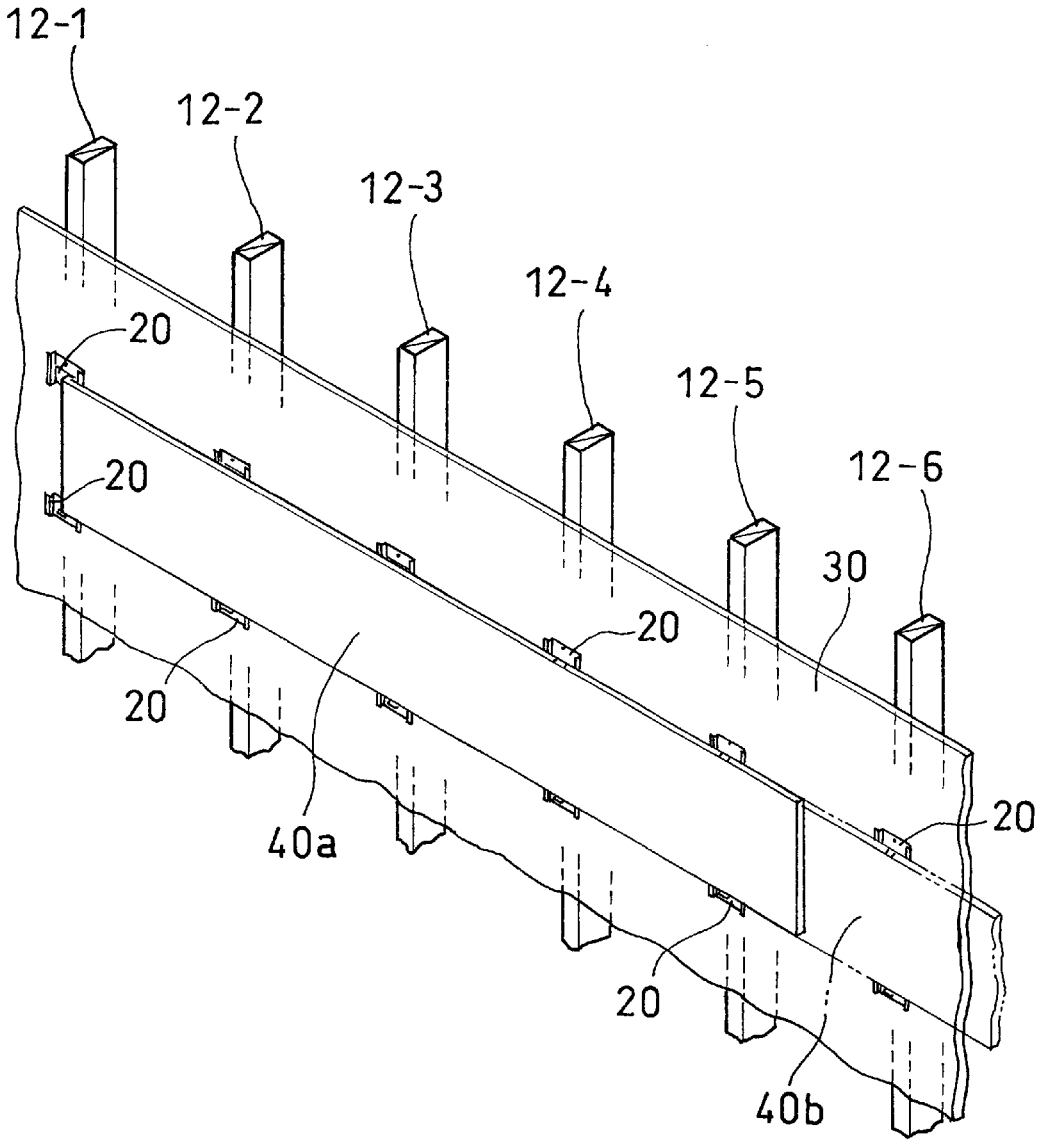
FIG. 9 is a perspective view illustrating a case where a joint portion between the vertical sides of siding boards arranged horizontally does not coincide with the position of any of the studs of framework.
Figure 10:
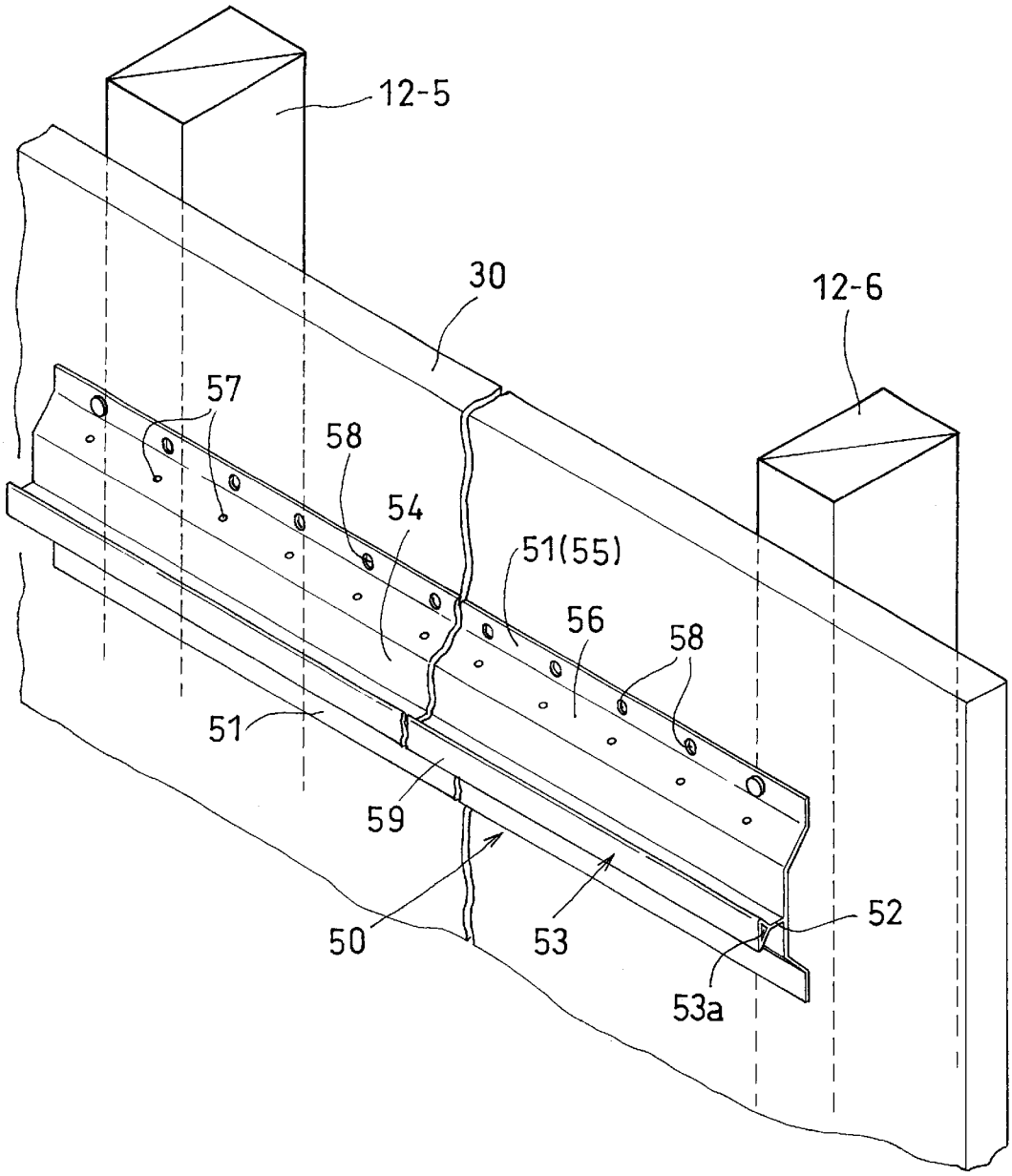
FIG. 10 is a perspective view illustrating a state wherein a second fixture is attached to the studs.

Namely, as shown in FIG. 9, when a situation where the joint portion between the vertical sides of the left siding board 40*a* and the right siding board 40*b* is not aligned with the position of stud 12 is caused to occur, the first fixture 20 is not employed. Instead, as shown in FIG. 10, the second fixture 50 is employed and fixed to the studs 12 so as to bridge the neighboring two studs 12-5 and 12-6 between which the aforementioned joint portion is located. As a result, the vertical sides of the left siding board 40*a* and the right siding board 40*b* is clamped and held in a continuous state by the upright portion 52 of the second fixture 50 and also by the engaging portion 53 formed at the distal end of the upright portion 52 and having a triangular cross-section. Additionally, since the opposite end portions of this second fixture 50 are fixedly attached to the studs 12-5 and 12-6 respectively by means of nails for instance, almost the same effect where the joint portion between the vertical sides of the left and right siding boards 40*a* and 40*b* is directly fixed to the building frame or the framework 10 can be achieved, thus making it possible to assure a stable fixing strength.

Figure 11:
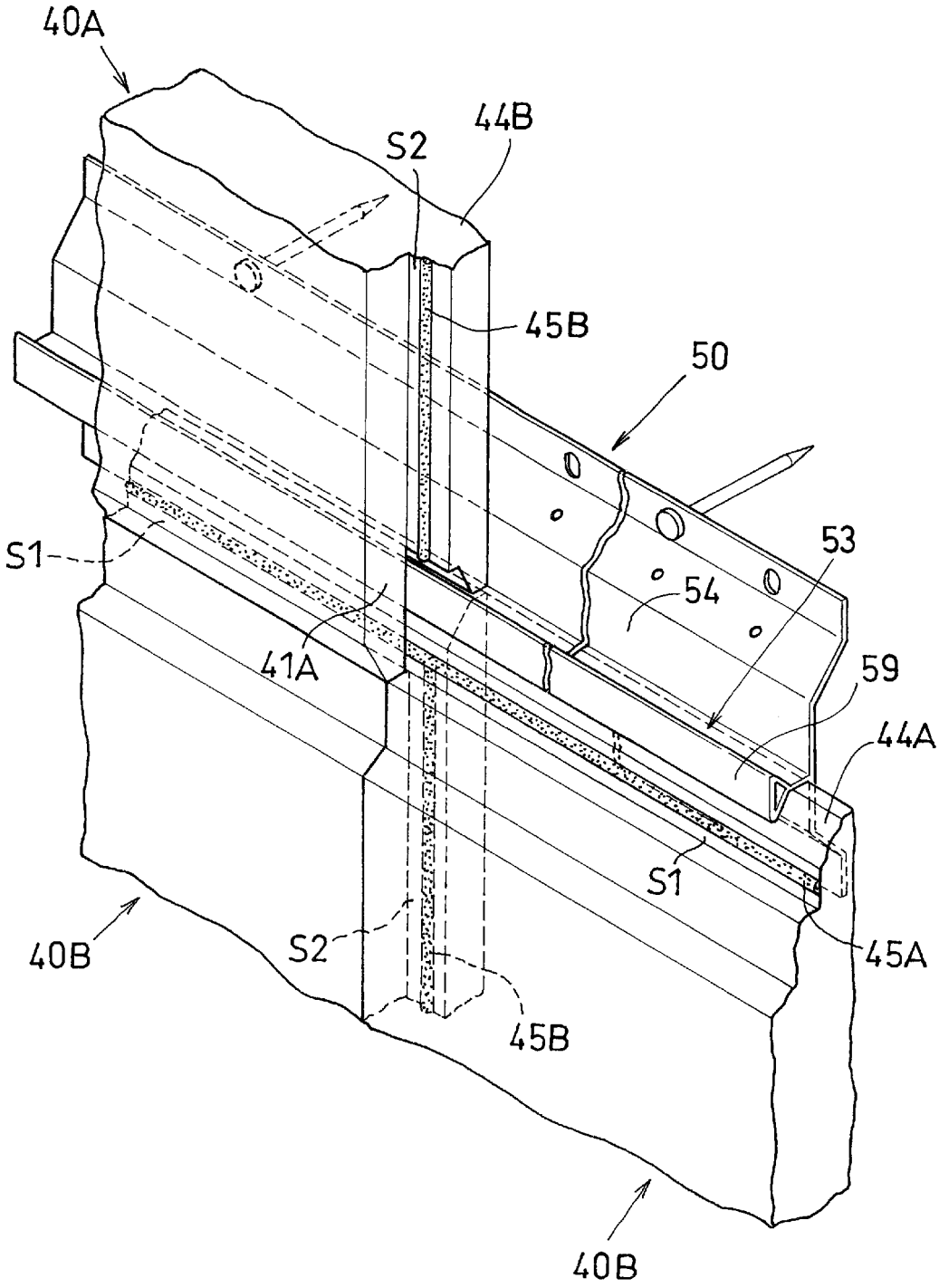
FIG. 11 is a perspective view illustrating a state wherein the siding boards are attached to the studs by making use of a second fixture.

FIG. 11 shows such a fastened state of the siding boards as explained above. Since this second fixture 50 is also provided with a flat portion 54 which is protruded forward from the substrate 51 by a distance of "h", and the distance "H" from the substrate 51 to the tip end of the upright portion 52 is made identical with the height "H" of the third upright portion 26 of the first fixture 10, no problem would be raised in installing the siding boards even if this second fixture 50 is substituted for the first fixture 20. Additionally, due to the provision of the aforementioned distance "h", a sufficient ventilation passage can be ensured on the rear side of the second fixture 50 as in the case of the first fixture 20.

In the embodiment shown in the drawings, the engaging portion 53 having a triangular cross-section in the upright portion 52 is configured such that the top surface 59 thereof is made flat. As a result, the following advantages can be obtained. Namely, when the siding board 40 is fastened to the second fixture 50, this flat top surface 59 is kept contacted with the rear surface of the overlying tongue patterning portion 41A of an upper siding board 40A as shown in FIG. 11. Therefore, rain water flowing down through a perpendicular space S2 formed between the right and left siding boards would be caused to deflect toward the foreside of the space when the rain water passes along the flat top surface 59. As a result, the retention of rain water in the vicinity of the engaging portion of the fixtures that has been often experienced in the conventional fixture can be completely prevented to occur, thus making it possible to reliably avoid the situation where rain water penetrates into the rear side of the siding boards 40.

Figure 12:
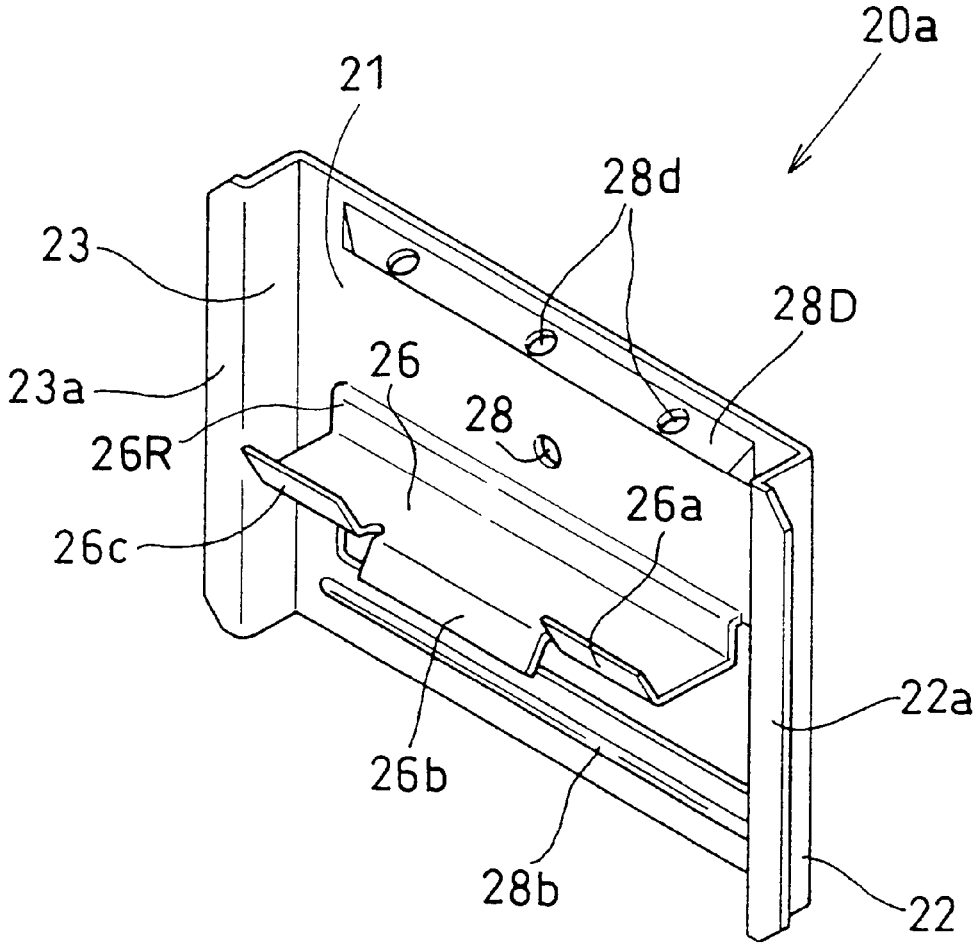
FIG. 12 is a perspective view illustrating another example of a first fixture.

FIG. 12 shows another embodiment of the first fixture 20. This fixture 20*a* differs from the aforementioned first fixture 20 in the respects that the proximal end portion of the third upright portion 26 which is bent from the substrate 21 is further bent into a round-shape thereby forming a curved portion 26R. Since this fixture 20*a* is provided with this curved portion 26R, the height "H" of the third upright portion 26 can be increased by this round-shaped portion, for example by about 2 mm.

This round-shaped portion can be formed in an additional step which may be carried out as the last step in the manufacture of the first fixture 20. Therefore, it is possible to easily obtain various kinds of fixtures adapted to be used for fastening the siding boards of different thickness (for example, which is suited for use for fastening a siding board having a thickness of 20 mm in separate from the siding board having a thickness of 18 mm which is employed in the aforementioned embodiment) by simply adding one step at the last of the manufacturing process of the fixture and by making use of the same metallic substrate.

Figure 13:
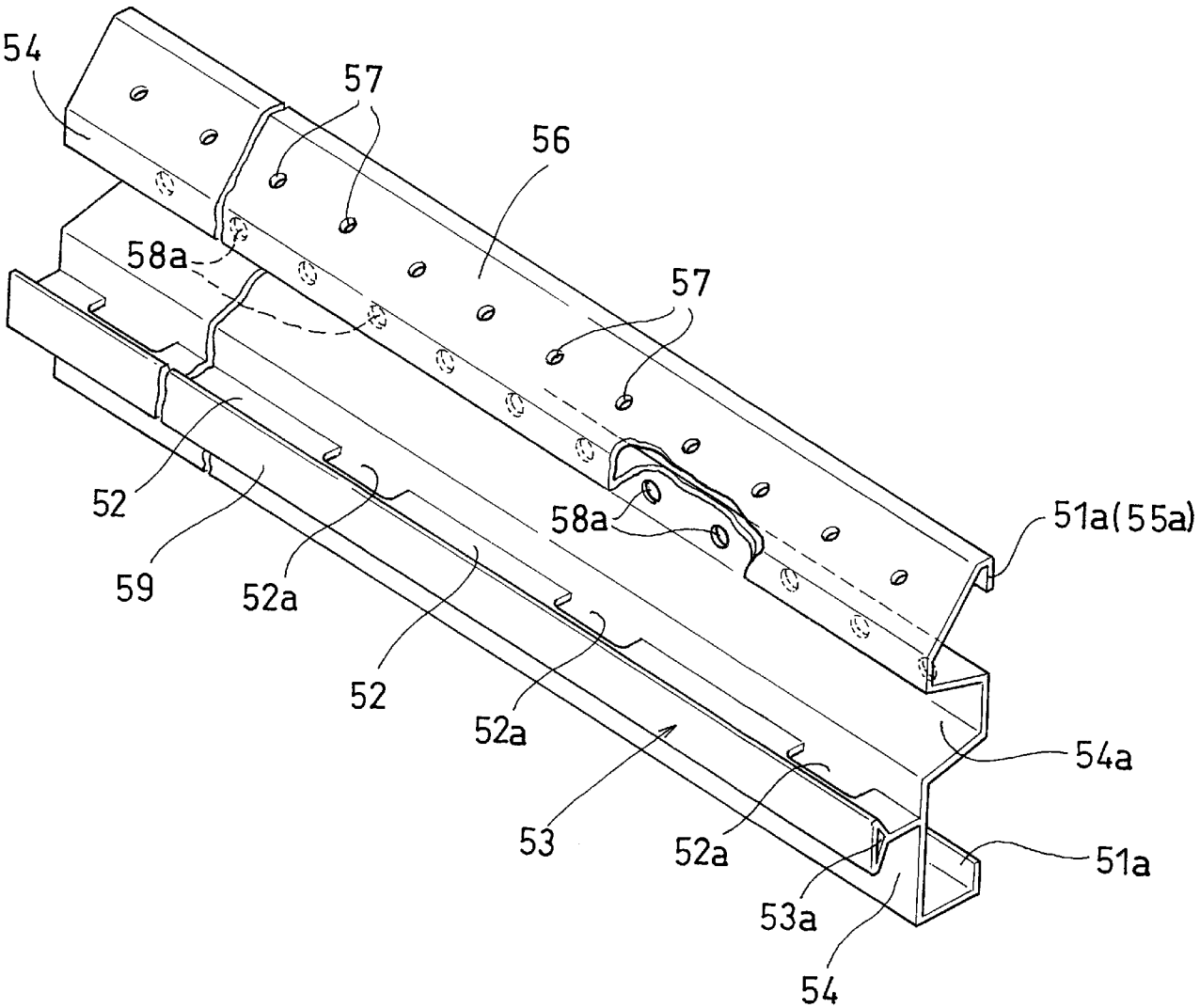
FIG. 13 is a perspective view illustrating another example of a second fixture.
Figure 14:
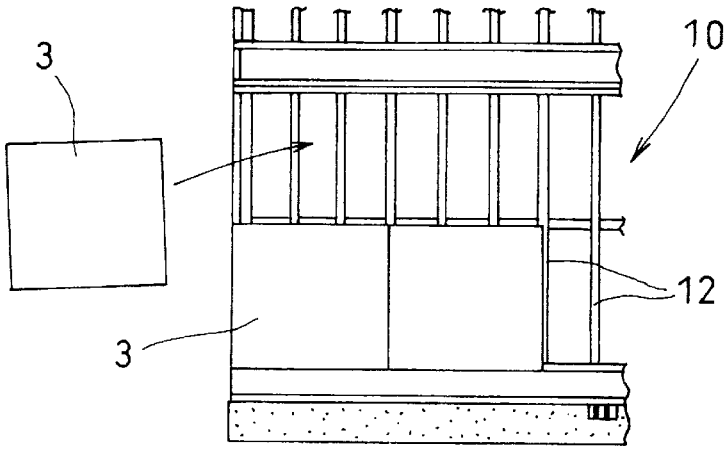
FIG. 14 PRIOR ART
FIG. 14 is a side view illustrating a wood frame construction (two-by-four work)
Figure 15:
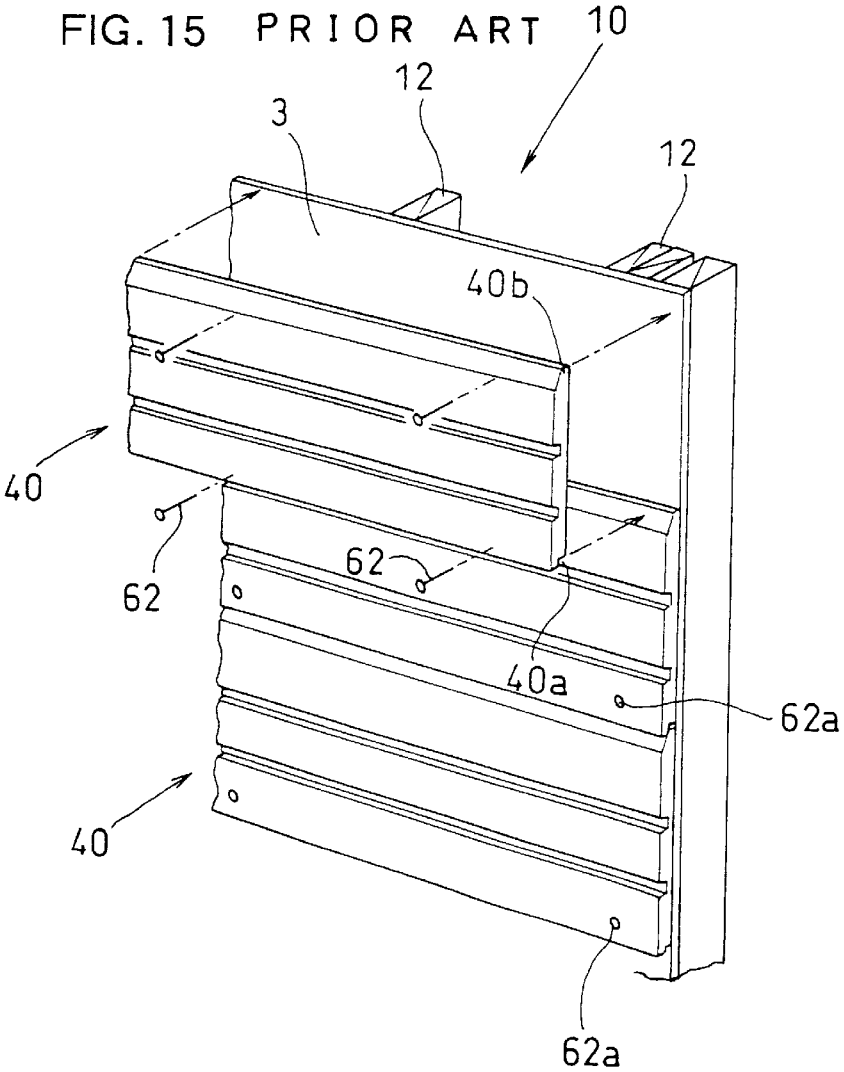
FIG. 15 PRIOR ART
FIG. 15 is a perspective view illustrating a siding work of the prior art for installing siding boards in a wood frame construction.
Figure 16:
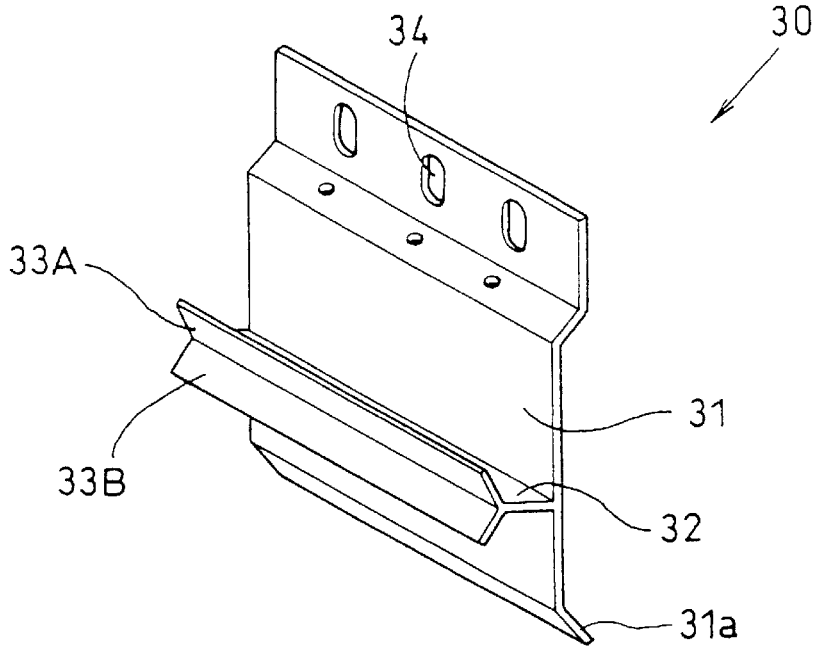
FIG. 16 PRIOR ART
FIG. 16 is a perspective view illustrating one example of a fixture of the prior art.

FIG. 13 shows another embodiment of the second fixture 50. The construction of this fixture 50*a* is basically the same as that of the aforementioned second fixture 50 shown in FIG. 4 but differs therefrom in the following respects. Namely, part of the flat portion 54 which is protruded forward is recessed backward or toward the flat substrate 51*a* thereby forming a U-groove 54*a*, the bottom of the U-groove 54*a* being flat and constituting the same level as that of the flat substrate 51*a*. Furthermore, through-holes 58*a* to be utilized for fixing or nailing this second fixture to the studs 12 are formed in the bottom of the U-groove 54*a*. Additionally, the flat substrate 51*a* is L-shaped with the edge thereof extending inward, and the upper end portion of the flat portion 54 and the substrate 51*a* (the upper horizontal portion 55*a*) are not provided with a through-hole. Further, the upright portion 52 is provided with a plurality of openings 52*a* for draining water.

According to this fixture 50*a*, the contact thereof to the studs 12 is effected by three portions, i.e. in addition to the upper and lower substrate portions 51*a*, the bottom of the U-groove 54*a*. Therefore, the mounting of the fixture 50*a* can be further stabilized and the structural strength of the fixture 50*a* can be further improved. Furthermore, since the openings 52*a* for draining water are formed in the upright portion 52, it becomes possible to more effectively prevent the back surface of the siding boards from being kept in a wet state. By the way, it is of course possible to provide the second fixture 50 shown in FIG. 4 with the openings 52*a* for draining water at the portion of upright portion 52.

According to the present invention, it is possible to firmly install the siding boards in the horizontal state to the framework by simply attaching a plurality of fixtures to each of the neighboring studs, thereby making it possible to greatly simplify the boarding and at the same time, to enhance the aesthetic feeling of the resultant structure.

According to the boarding method of the present invention, even if a joint portion between the vertical sides of neighboring siding boards arranged horizontally does not coincide with the position of any of said studs but is positioned at an intermediate place between the studs due to a difference in standard with which the studs and siding boards are separately fabricated, the joint portion can be reliably fastened by making use of the second fixture.

It is also possible according to the present invention to fasten the siding boards to the studs with a thick backing board formed of a relatively soft material such as a foamed resin board (a heat insulating material) being interposed therebetween without causing a displacement of the fixture due to the weight of the siding boards, thus making it possible to ensure a stabilized installation condition of the siding boards.

By making use of the aforementioned fixture having an engaging portion whose top portion is made into a flat surface, it is possible, even if the joint portion between the vertical sides of neighboring siding boards is located at an intermediate portion between the studs, to effectively prevent rain water from penetrating through this joint portion into the backside of the siding boards.

In the case of the aforementioned fixture whose upright portion is formed of a bent piece of the substrate portion where the proximal end portion of the bent piece is further bent into a round-shape by a pressing-up of the proximal end portion from the back side thereof, a plural kinds of fixtures each being adapted for use in the fastening of a plural kinds of siding boards each differing in thickness can be manufactured using a common metallic substrate and requiring a reduced number of manufacturing steps, thereby making it possible to minimize the manufacturing cost of the fixtures.

Additionally, even if dew is generated on the rear side of the siding boards installed as mentioned above, the dew water can be effectively discharged, thus making it possible to prevent the back surface of the siding boards from being kept in a wet state.

What is claimed is:

1. A fixture for fastening horizontal siding boards using at least two studs erected side by side, said fixture comprising:

a substrate constituting at least a mounting surface adapted to be contacted with said studs, said substrate having a single raised flat portion protruding in a direction away from the mounting surface;

an upright portion formed substantially perpendicular to said flat portion. projecting in the direction away from the mounting surface, and extending substantially throughout an entire lateral width of said flat portion; and an engaging portion formed at a distal end of said upright portion;

wherein the mounting surface of said fixture has a laterally elongated width sufficient to bridge said two studs;

said upright portion projects from a middle region of said flat portion, dividing said flat portion into an upper region and a lower region; and said upright portion is provided with openings for drainage of water.

2. A fixture for fastening horizontal siding boards using at least two studs erected side by side, said fixture comprising:

a substrate constituting at least a mounting surface adapted to be contacted with said studs, said substrate having a single raised flat portion protruding in a direction away from the mounting surface;

an upright portion formed substantially perpendicular to said flat portion, projecting in the direction away from the mounting surface, and extending substantially throughout an entire lateral width of said flat portion; and an engaging portion formed at a distal end of said upright portion;

wherein the mounting surface of said fixture has a laterally elongated width sufficient to bridge said two studs;

said upright portion projects from a middle region of said flat portion, dividing said flat portion into an upper region and a lower region; and the at least one mounting surface includes upper and lower mounting surfaces formed at opposite sides corresponding to the upper and lower regions of said flat portion, and extending along the lateral width of said flat portion.

3. A fixture for fastening horizontal siding boards using at least two studs erected side by side, said fixture comprising:

a substrate constituting at least a mounting surface adapted to be contacted with said studs, said substrate having a single raised flat portion protruding in a direction away from the mounting surface;

an upright portion formed substantially perpendicular to said flat portion, projecting in the direction away from the mounting surface, and extending substantially throughout an entire lateral width of said flat portion; and an engaging portion formed at a distal end of said upright portion;

wherein the mounting surface of said fixture has a laterally elongated width sufficient to bridge said two studs;

said upright portion projects from a middle region of said flat portion, dividing said flat portion into an upper region and a lower region; and said engaging portion has first and second members obliquely extending away from the mounting surface and inclined downward and upward from the upright portion, respectively, and a third member connecting distal ends of the first and second members, said first, second arid third members of said engaging portions together define a hollow space.

4. A method of installing horizontal siding boards, comprising the steps of a) erecting a plurality of studs side by side;

b) providing a plurality of fixtures, each having an engaging portion adapted to be engaged with lower and upper horizontal side edges of the horizontal siding boards;

c) attaching a number of said fixtures, each to at least one of the studs, with their respective engaging portions being orientated horizontally;

d) horizontally placing said siding boards on said attached fixtures while allowing their lower horizontal side edges to be engaged with said engaging portions of said attached fixtures;

e) attaching another number of said fixtures, each to at least one of the studs, with the engaging portions thereof being engaged with the upper horizontal side edges of said siding boards previously placed horizontally; and f) repeating one or more of aforementioned steps c) through e);

wherein only when a joint between vertical side edges of adjacent said siding boards falls in a space between a pair of adjacent said studs, at least one of the fixtures attached to said pair of adjacent studs is chosen to have a laterally elongated width, with respect to the rest of said fixtures, which is sufficient to bridge said pair of adjacent studs, thereby reliably fastening said joint of said adjacent siding boards;

said method further comprising the step of attaching a backing board to the studs prior to said steps c) and e) so that said fixtures are fastened to the studs with said backing board being interposed therebetween, wherein said backing board is made of heat insulating material.

5. A method of installing horizontal siding boards, comprising the steps of a) erecting a plurality of studs side by side;

b) providing a plurality of fixtures, each having an engaging portion adapted to be engaged with lower and upper horizontal side edges of the horizontal siding boards;

c) attaching a number of said fixtures, each to at least one of the studs, with their respective engaging portions being orientated horizontally;

d) horizontally placing said siding boards on said attached fixtures while allowing their lower horizontal side edges to be engaged with said engaging portions of said attached fixtures;

e) attaching another number of said fixtures, each to at least one of the studs, with the engaging portions thereof being engaged with the upper horizontal side edges of said siding boards previously placed horizontally; and f) repeating one or more of aforementioned steps c) through e);

wherein only when a joint between vertical side edges of adjacent said siding boards falls in a space between a pair of adjacent said studs, at least one of the fixtures attached to said pair of adjacent studs is chosen to have a laterally elongated width, with respect to the rest of said fixtures, which is sufficient to bridge said pair of adjacent studs, thereby reliably fastening said joint of said adjacent siding boards; and the vertical side edges of said horizontally adjacent horizontal boards abut against each other.

6. A method of installing horizontal siding boards, comprising the steps of a) erecting a plurality of studs side by side;

b) providing a plurality of fixtures, each having an engaging portion adapted to be engaged with lower and upper horizontal side edges of the horizontal siding boards;

c) attaching a number of said fixtures, each to at least one of the studs, with their respective engaging portions being orientated horizontally;

d) horizontally placing said siding boards on said attached fixtures while allowing their lower horizontal side edges to be engaged with said engaging portions of said attached fixtures;

e) attaching another number of said fixtures, each to at least one of the studs, with the engaging portions thereof being engaged with the upper horizontal side edges of said siding boards previously placed horizontally; and f) repeating one or more of aforementioned steps c) through e);

wherein only when a joint between vertical side edges of adjacent said siding boards falls in a space between a pair of adjacent said studs, at least one of the fixtures attached to said pair of adjacent studs is chosen to have a laterally elongated width, with respect to the rest of said fixtures, which is sufficient to bridge said pair of adjacent studs, thereby reliably fastening said joint of said adjacent siding boards;

all of said fixtures are attached to at least one of the studs; and at least one of said fixtures has a width substantially smaller than a horizontal dimension of the space between said pair of adjacent studs, and hence, smaller than the laterally elongated width of said selected fixture.

7. A finished wall construction, comprising:

at least two studs erected side by side;

at least two horizontal siding boards each having upper and lower horizontal side edges and at least one vertical side edge; and at least two fastening elements each including:

a substrate having at least a mounting surface and a raised flat portion protruding away from the mounting surface;

an upright portion projecting from said flat portion in a direction away from the mounting surface; and an engaging portion formed at a distal end of said upright portion;

wherein at least one of said fastening elements has a laterally elongated width sufficient to bridge said two studs;

the mounting surface of each of said fastening elements is fastened to and in contact with at least one of said studs so that said at least one of said fastening elements spans over a spacing between said studs;

said siding boards are positioned between said fastening elements so that the upper and lower side edges of said siding boards are engaged with said engaging portions of said fastening elements, while the vertical side edges of said siding boards abut against each other to form a joint in said spacing.

8. The finished wall construction of claim 7, wherein each of said engaging portions is configured to have a flat surface at a farthest end thereof which abuts against a back surface of at least one of said siding boards.

9. The finished wall construction of claim 7, further comprising a backing board made of heat insulating material and interposed between said studs and said fastening elements.

10. The finished wall construction of claim 7, wherein the engaging portion of said at least one of said fastening elements extends substantially throughout the laterally elongated width thereof.

11. The finished wall construction of claim 10, wherein the engaging portion of said at least one of said fastening elements is engaged with one of the upper and lower horizontal side edges of both of said siding boards.

12. The finished wall construction of claim 7, wherein each of said engaging portions has first and second members obliquely extending away from the mounting surface and inclined downward and upward from the upright portion, respectively, and a third member connecting distal ends of the first and second members, said first, second and third members of said engaging portions together define a hollow space.

13. The finished wall construction of claim 7, further comprising:

a third stud erected next to one of said studs; and at least a third fastening element fastened to said third stud and having an engaging portion engaged with one of the upper and lower horizontal side edges of one of said siding boards;

wherein said third fastening element has a width substantially smaller than said spacing between said studs, and hence, smaller than the laterally elongated width of said at least one of said fastening elements.

14. The finished wall construction of claim 13, wherein the engaging portion of said third fastening element is configured to have a flat surface at a farthest end thereof which abuts against a back surface of said one of said siding boards.

* * * * *